US010415601B2

(12) United States Patent
Thawani et al.

(10) Patent No.: US 10,415,601 B2
(45) Date of Patent: Sep. 17, 2019

(54) BLOWER NOISE SUPPRESSOR

(71) Applicants: DENSO International America, Inc., Southfield, MI (US); DENSO CORPORATION, Kariya, Aichi-pref. (JP)

(72) Inventors: Prakash Thawani, Bloomfield Hills, MI (US); Stephen Sinadinos, Commerce Township, MI (US)

(73) Assignees: DENSO International America, Inc., Southfield, MI (US); DENSO CORPORATION, Kariya, Aichi-pref. (JP)

( * ) Notice: Subject to any disclaimer, the term of this patent is extended or adjusted under 35 U.S.C. 154(b) by 115 days.

(21) Appl. No.: 15/644,165

(22) Filed: Jul. 7, 2017

(65) Prior Publication Data

US 2019/0010959 A1 Jan. 10, 2019

(51) Int. Cl.

| | |
|---|---|
| ***F04D 29/66*** | (2006.01) |
| ***F04D 29/28*** | (2006.01) |
| ***F04D 29/42*** | (2006.01) |
| ***F04D 29/44*** | (2006.01) |
| ***F04D 17/16*** | (2006.01) |

(52) U.S. Cl.

CPC ..... *F04D 29/663* (2013.01); *F04D 17/16* (2013.01); *F04D 29/281* (2013.01); *F04D 29/282* (2013.01); *F04D 29/422* (2013.01); *F04D 29/4206* (2013.01); *F04D 29/441* (2013.01); *F04D 29/665* (2013.01)

(58) Field of Classification Search

CPC ..... F04D 17/10; F04D 17/16; F04D 23/003; F04D 25/08; F04D 29/281; F04D 29/4206; F04D 29/422; F04D 29/428; F04D 29/4233; F04D 29/441; F04D 29/541; F04D 29/547; F04D 29/66; F04D 29/661; F04D 29/663; F04D 29/664; F04D 29/665; F04D 29/666; F04D 29/667; F04D 29/668

See application file for complete search history.

(56) References Cited

U.S. PATENT DOCUMENTS 1,439,365 A * 12/1922 Hazell ..... F04D 29/2266 415/204
2,160,666 A * 5/1939 McMahan ..... F04D 29/281 181/207
2,171,341 A * 8/1939 McMahan ..... F04D 29/422 181/256
3,286,914 A * 11/1966 Baverstock ..... F04D 29/668 415/119
3,398,882 A * 8/1968 Zenkner ..... F04D 17/04 415/53.1

(Continued)

*Primary Examiner* — Hung Q Nguyen
*Assistant Examiner* — Brian P Monahon
(74) *Attorney, Agent, or Firm* — Harness, Dickey & Pierce, P.L.C.

(57) ABSTRACT

A blower assembly including a housing, a blower within the housing, and a cut-off that is within the housing downstream of the blower with respect to direction of airflow generated by the blower. Openings are defined by the cut-off. The openings are configured to permit airflow generated by the blower to pass through the openings and to a discharge outlet of the blower assembly. The openings are further configured to reduce blower frequency tone generated as airflow passes across the cut-off.

2 Claims, 3 Drawing Sheets

(56) References Cited

U.S. PATENT DOCUMENTS 3,684,396 A * 8/1972 Ball ..... F04D 29/422 415/144
3,695,775 A * 10/1972 Zenkner ..... F04D 17/04 415/119
4,174,020 A * 11/1979 Challis ..... F04D 29/424 181/211
4,891,169 A * 1/1990 Kaplan ..... F24F 5/0035 138/177
5,286,162 A * 2/1994 Veres ..... F04D 29/422 415/115
5,340,275 A * 8/1994 Eisinger ..... F04D 29/665 181/224
6,142,732 A * 11/2000 Chou ..... F01D 9/026 415/119
6,379,110 B1 * 4/2002 McCormick ..... B64C 23/00 415/115
6,935,835 B2 * 8/2005 Della Mora ..... F04D 29/422 415/119
7,677,237 B2 * 3/2010 Hancock ..... F24H 3/087 126/104 A
8,403,663 B2 * 3/2013 Hilgers ..... A61C 7/00 433/18
8,573,558 B2 11/2013 Wang
9,168,476 B2 10/2015 Castro et al.
9,170,616 B2 10/2015 Beltman et al.
2005/0104265 A1 5/2005 Tanaka et al.
2005/0276684 A1 * 12/2005 Huang ..... F04D 29/422 415/119
2009/0145583 A1 * 6/2009 Han ..... F04D 29/282 165/121
2009/0232648 A1 * 9/2009 Wu ..... F04D 29/4226 415/204
2010/0040456 A1 * 2/2010 Hwang ..... F04D 25/0613 415/119
2010/0104421 A1 * 4/2010 Hwang ..... F04D 25/0613 415/119
2012/0244314 A1 9/2012 Scheibner et al.
2013/0108414 A1 * 5/2013 Maeda ..... F01D 25/24 415/144
2013/0256056 A1 * 10/2013 Wiegers ..... F01N 13/18 181/282
2014/0178194 A1 * 6/2014 Tamaoka ..... F04D 17/16 415/212.1
2016/0195106 A1 * 7/2016 Uehara ..... F04D 29/422 415/119
2018/0283396 A1 * 10/2018 Iwasaki ..... F04D 29/4226

* cited by examiner

BLOWER NOISE SUPPRESSOR

FIELD

The present disclosure relates to a noise suppressor for a blower, such as a blower for a heating, ventilation, and air conditioning system.

BACKGROUND

This section provides background information related to the present disclosure, which is not necessarily prior art.

Prior art FIG. 1 illustrates a blower assembly 10, which includes a housing 12 with a blower wheel 14 therein. The blower wheel 14 includes a plurality of blower blades 16. The blower wheel 14 rotates about a center axis 18. As the blower wheel 14 rotates, the blower blades 16 generate airflow through the housing 12 to a discharge outlet 20. From the discharge outlet 20 airflow generated by the blower wheel 14 can be directed to an evaporator 22, or to any other suitable device and/or location. As the blower wheel 14 rotates in the clockwise direction, some of the airflow generated may follow the blower wheel 14 and recirculate by continuing to circulate with the blower wheel 14 instead of flowing to the discharge outlet 20.

To divert airflow from recirculating with the blower wheel 14, a cut-off resonator 30 can be included within the housing 12 adjacent to the blower wheel 14. The cut-off 30 effectively peels airflow off of the blower wheel 14, and thereby increases the volume of airflow flowing to and through the discharge outlet 20. In the example of FIG. 1, the cut-off 30 is a straight cutoff, and includes an upstream surface 32 generally facing the blower wheel 14. A downstream surface 34 is opposite to the upstream surface 32, and an upper edge 36 is between the upstream surface 32 and the downstream surface 34. The cut-off 30 can be made of any suitable material, such as any suitable polypropylene, acrylonitrile butadiene styrene (ABS), or any other suitable plastic material. The cut-off 30 can be secured within the housing 12 in any suitable manner, such as with any suitable adhesive or mechanical fastener, or may be formed integral with the housing 12.

With reference to prior art FIG. 2, an inclined cut-off 50 can be included in place of the straight cut-off 30. The inclined cut-off 50 includes a first chamber 52 and a second chamber 54 adjacent thereto. The first chamber 52 includes a first upstream surface 60 facing the blower wheel 14, and a first downstream surface 62, which is opposite to the first upstream surface 60. Between the first upstream surface 60 and the first downstream surface 62 is a first inclined upper edge 64. The second chamber 54 is smaller than the first chamber 52, and includes a second upstream surface 70 and a second downstream surface 72. The second upstream surface 70 faces the blower wheel 14, and the second downstream surface 72 is opposite to the second upstream surface 70. Between the second upstream surface 70 and the second downstream surface 72 is a second inclined upper edge 74, which is lower than the first inclined upper edge 64. A bottom surface 76 is opposite to the first and second inclined upper edges 64 and 74.

Although the straight cut-off 30 and the inclined cut-off 50 are suitable for their intended use, they are subject to improvement. For example, the cut-offs 30 and 50 often generate undesirable audible tones and broadband high frequency noise as airflow from the blower wheel 14 flows over the cut-offs 30 and 50. The present teachings provide for improved cut-off resonators that address these issues in the art, as well as numerous others as one skilled in the art will appreciate.

SUMMARY

This section provides a general summary of the disclosure, and is not a comprehensive disclosure of its full scope or all of its features.

The present teachings provide for a blower assembly including a housing, a blower within the housing, and a cut-off that is within the housing downstream of the blower with respect to direction of airflow generated by the blower. Openings are defined by the cut-off. The openings are configured to permit airflow generated by the blower to pass through the openings and to a discharge outlet of the blower assembly. The openings are further configured to reduce blower frequency tone generated as airflow passes across the cut-off.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Prior art FIG. 1 illustrates a blower assembly including a straight cut-off;

Prior art FIG. 2 illustrates a blower assembly including an inclined cut-off;

Corresponding reference numerals indicate corresponding parts throughout the several views of the drawings.

DETAILED DESCRIPTION

Example embodiments will now be described more fully with reference to the accompanying drawings.

Figure 1:
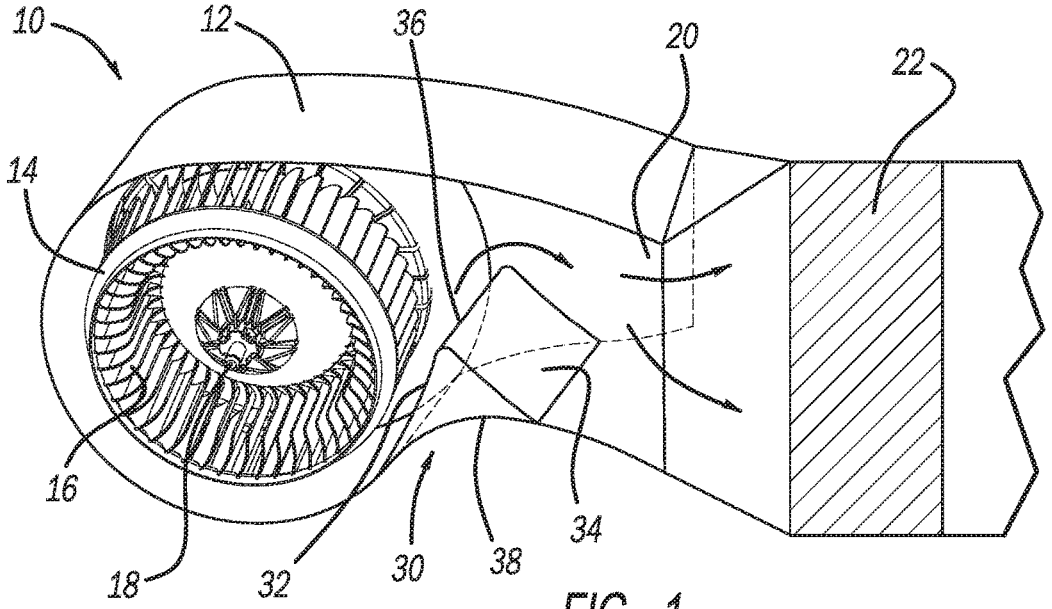
FIG - 1 Prior Art
Figure 2:
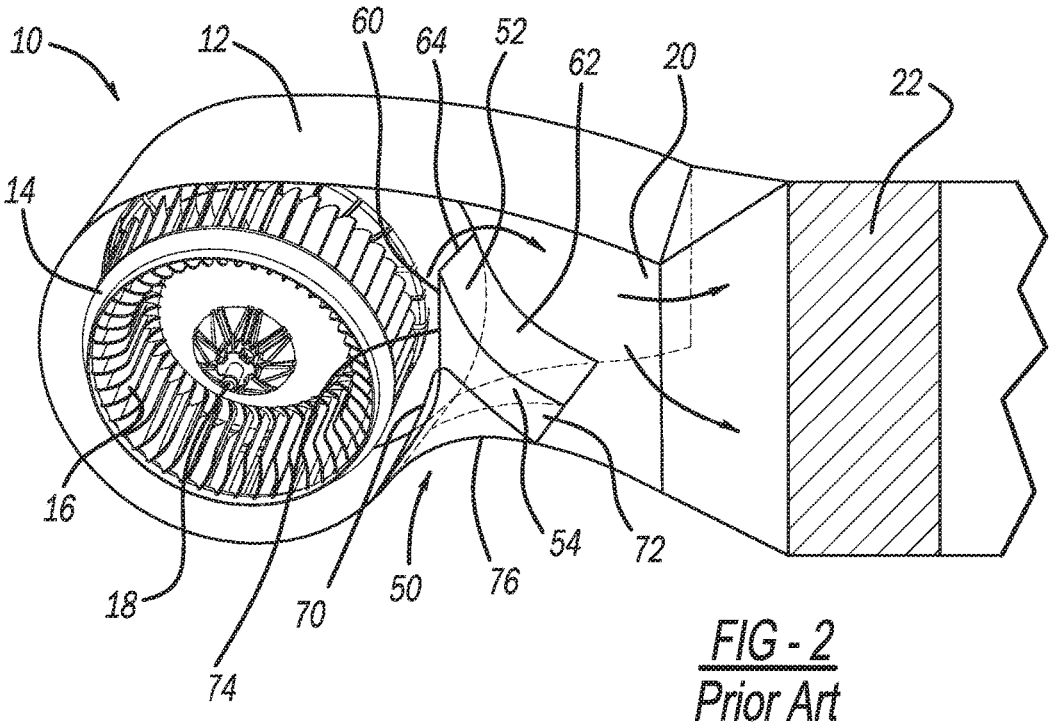
FIG - 2 Prior Art
Figure 3:
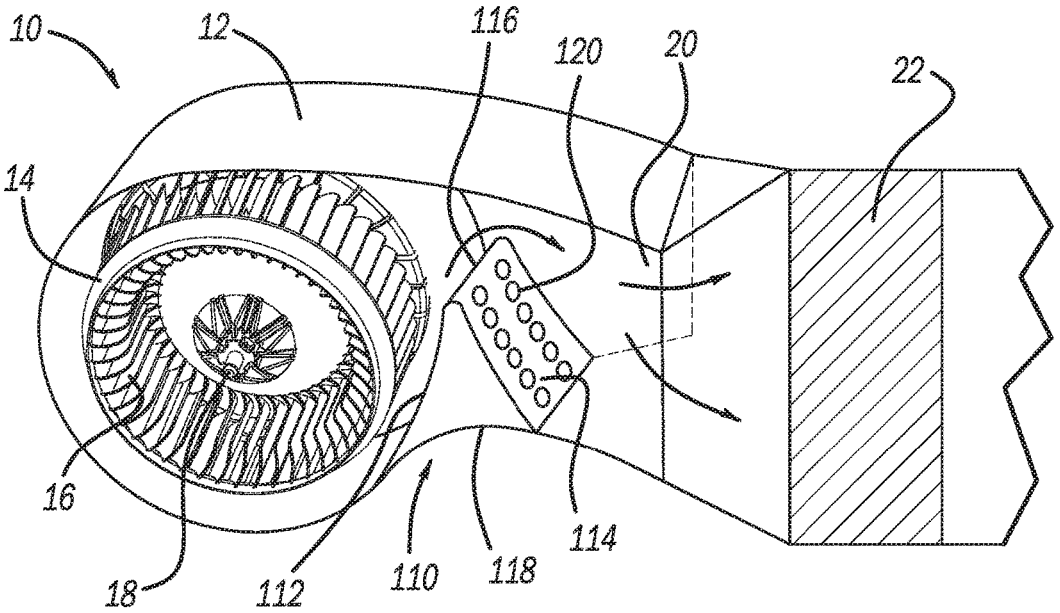
FIG. 3 illustrates a blower assembly including a straight cut-off in accordance with the present teachings.

With reference to FIG. 3, the blower assembly 10 is illustrated as including a straight cut-off 110 in accordance with the present teachings. The straight cut-off 110 includes an upstream surface 112, a downstream surface 114, an upper edge 116, and a bottom surface 118. The upstream surface 112 generally faces the blower wheel 14, and the downstream surface 114 is opposite to the upstream surface 112. The upper edge 116 and the bottom surface 118 are between the upstream and downstream surface 112 and 114. The upstream surface 112 and the downstream surface 114 each define one or more openings or perforations 120. The perforations 120 generally provide an airflow passageway through the cut-off 110, through which airflow generated by the blower wheel 14 is able to pass as the airflow flows from the blower wheel 14 to the discharge outlet 20. The perforations 120 reduce or eliminate blower frequency tone generated as airflow from the blower wheel 14 flows across and through the cut-off 110.

The number, size, and location of the perforations 120, as well as the overall dimensions of the cut-off 30, may be varied based on characteristics of the blower assembly 10, such as typical operating speed of the blower wheel 14. For example, for a blower wheel 14 that typically operates at a relatively high speed in the range of 1,000-4,500 RPM the perforations 120 may be holes, slots, louvres, or micro-perforations with a porosity of 3%-10% of the open surface area (or greater) configured to most effectively reduce or eliminate blower induced and/or broadband noise. For a blower wheel 14 that operates at a relatively lower speed in the range of 1,000 to 4,500 RPM, the perforations 120 may be holes, slots, louvres, or micro-perforations with a porosity of 3%-10% of the open surface area (or greater) configured to most effectively reduce or eliminate blower induced and/or broadband noise at the relatively lower speed. The perforations 120 and resonator volume is advantageously tuned to suppress the undesirable noise frequencies, for example.

Figure 4:
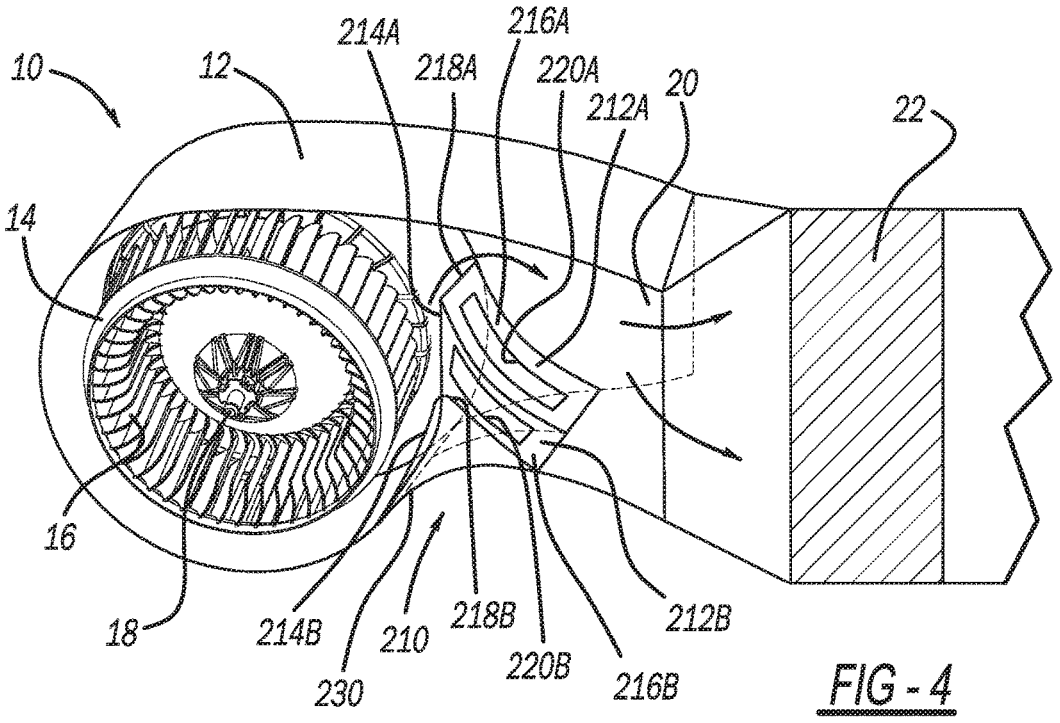
FIG. 4 illustrates a blower assembly including an inclined cut-off according to the present teachings.

FIG. 4 illustrates an inclined cut-off according to the present teachings at reference numeral 210. The inclined cut-off 210 includes a first chamber 212A and a second chamber 212B, which are adjacent to one another. The first chamber 212A includes a first upstream surface 214A facing the blower wheel 14, and a first downstream surface 216A, which is opposite to the first upstream surface 214A. Between the first upstream surface 214A and the first downstream 216A is a first inclined upper edge 218A. The second chamber 212B includes a second upstream surface 214B facing the blower wheel 14, and a second downstream surface 216B, which is opposite to the second upstream surface 214B. Between the second upstream surface 214B and the second downstream surface 216B is a second inclined upper edge 218B. Opposite to the first and second inclined upper edges 218A and 218B is a lower surface 230. In the example illustrated, the second chamber 212B is smaller than the first chamber 212A, and the second inclined upper edge 218B is lower than the first inclined upper edge 218A. However, the first and second chambers 212A and 2128 can have any suitable size and shape to most effectively reduce/eliminate blower frequency tone generated by the blower wheel 14.

Each one of the first upstream surface 214A and the first downstream surface 216A defines a first slot 220A, which provides a first airflow passageway through the first chamber 212A. Each one of the second upstream surface 214B and the second downstream surface 216B defines a second slot 220B, which provides an airflow passageway through the second chamber 212B of the cut-off 210. The first pair of slots 220A and the second pair of slots 220B advantageously permit airflow generated by the blower wheel 14 to pass through the inclined cut-off 210 to the discharge outlet 20, and reduce or eliminate blower frequency tone generated as airflow passes across the cut-off 210 and through the first pair of slots 220A and second pair of slots 220B.

The first pair of slots 220A and the second pair of slots 220B may be sized and shaped in any suitable manner, and included in any suitable number, to most effectively reduce blower frequency tone, and thus "tune" the inclined cutoff 210 based on, for example, the typical operating speed of the blower wheel 14. For example, if the blower wheel 14 typically operates at a relatively high speed in the range of 1,000 to 4,500 RPM, the first and second slots 220A and 220B may be holes, slots, louvres, or micro-perforations with porosity of 3%-10% of the open surface area or greater configured to most effectively reduce or eliminate blower induced and/or broadband noise at the relatively high speed. When the blower wheel 14 operates at a relatively lower speed in the range of 1,000 to 4,500 RPM, the first and second slots 220A and 220B may be holes, slots, louvres, or micro-perforations with porosity of 3%-10% of the open surface area or greater configured to most effectively reduce or eliminate blower induced and/or broadband noise at the relatively lower speed.

Figure 5:
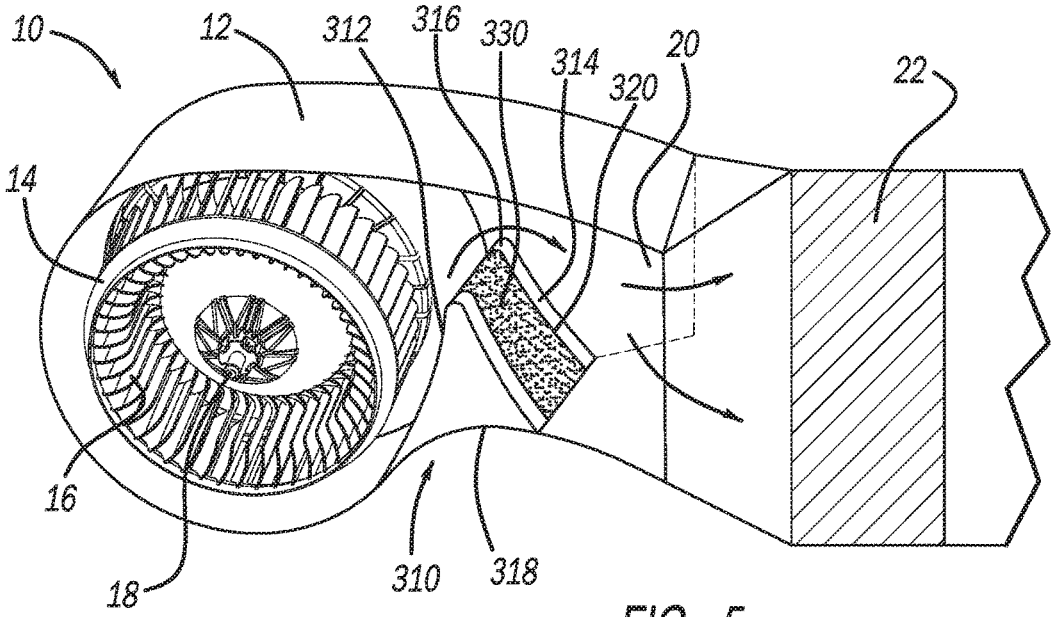
FIG. 5 illustrates a blower assembly including an additional straight cut-off according to the present teachings.

With reference to FIG. 5, an additional straight cut-off in accordance with the present teachings is illustrated at reference numeral 310. The straight cut-off 310 includes an upstream surface 312 facing the blower wheel 14, and a downstream surface 314, which is opposite to the upstream surface 312. Between the upstream and downstream surfaces 312 and 314 is an upper edge 316. A bottom surface 318 is opposite to the upper edge 316. The upstream surface 312, the downstream surface 314, and the upper edge 316 each define a cut-out 320. Arranged at the cut-out 320 is a perforated panel 330, which defines a plurality of openings. The openings can have any suitable shape and size. For example, the perforated panel 330 can be a microperforated panel (MPP), such as an MPP having micro-perforations with a porosity of 3%-10% of the open surface area (or greater). An exemplary perforated panel 330 that may be used includes any suitable microperforated panel. The openings of the perforated panel 330 reduce blower frequency tone generated as airflow passes through the openings of the perforated panel 330 and across the cut-off 310. The perforated panel 330 can be secured at the cut-out 320 in any suitable manner, such as with any suitable adhesive and/or with any suitable mechanical fastening, such as a snap-fit.

Figure 6:
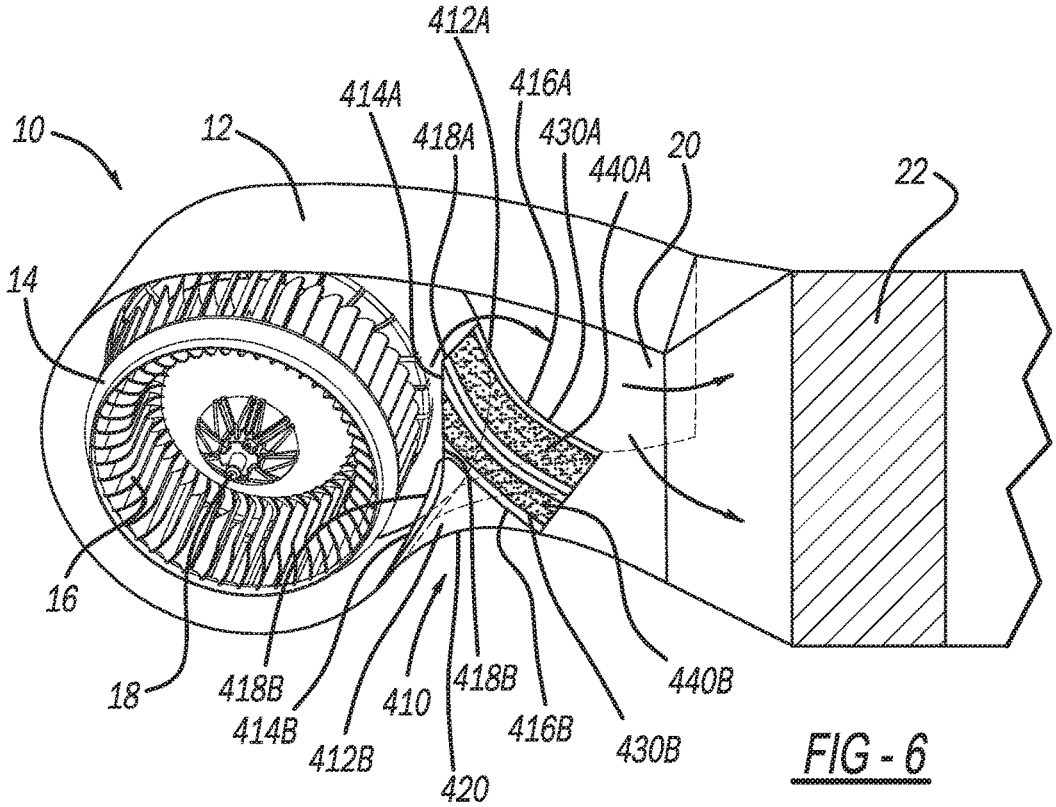
FIG. 6 illustrates a blower assembly including another inclined cut-off according to the present teachings.

FIG. 6 illustrates another inclined cut-off according to the present teachings at reference numeral 410. The cut-off 410 includes a first chamber 412A and a second chamber 412B. The first chamber 412A includes a first upstream surface 414A and a first downstream surface 416A. The first upstream surface 414A faces the blower wheel 14, and the first downstream surface 416A is opposite to the first upstream surface 414A. Between the first upstream surface 414A and the first downstream surface 416A is a first inclined upper edge 418A. The second chamber 412B includes a second upstream surface 414B facing the blower wheel 14, and a second downstream surface 416B that is opposite to the second upstream surface 414B. Between the second upstream surface 414B and the second downstream surface 416B is a second inclined upper edge 418B. Opposite to the first and second inclined upper edges 418A and 418B is a bottom surface 420. In the example illustrated, the second inclined upper edge 418B is lower than the first inclined upper edge 418A, and the second chamber 412B is smaller than the first chamber 412A. The first and second chambers 412A and 412B can have any other suitable sizes and shapes to more effectively reduce or eliminate blower frequency tone generated as airflow passes across and through the cut-off 410.

With respect to the first chamber 412A, the first upstream surface 414A, the first downstream surface 416A, and the first inclined upper edge 418A each define a first cut-out 430A. With respect to the second chamber 412B, the second upstream surface 414B, the second downstream surface 416B, and the second inclined upper edge 418B each define a second cut-out 430B. Arranged at the first cut-out 430A is a first perforated panel 440A, and arranged at the second cut-out 430B is a second perforated panel 440B. The first and second perforated panels 440A and 440B can be secured in any suitable manner, such as with any suitable adhesive and/or mechanical connection, such as a snap-fit.

Each one of the perforated panels 440A and 440B define a plurality of openings that are configured to permit airflow generated by the blower 14 to pass through the first and second cut-outs 430A and 430B to the discharge outlet 20. The openings of the first and second perforated panels 440A and 440B advantageously reduce blower frequency tone generated as airflow passes across the cut-off 410 and through the first and second perforated panels 440A and 440B. The openings of the first and second perforated panels 440A and 440B can have any suitable shape and size. For example, the openings of the perforated panels 440A and 440B can be micro sized openings, such as with a size of 3%-10% of the open surface area (or greater). Any suitable microperforated panel can be used for the perforated panels 440A and 440B.

The perforated panels 330, 440A, and 440B can be selected based on the characteristics of the blower assembly 10 so as to "tune" the straight cut-off 310 and the inclined cut-off 410 to reduce or eliminate the blower frequency tone. For example, with blower wheels 14 typically operating at relatively high speeds in the range of 1,000-4,500 RPM, a perforated panel 330, 440A, 440B having holes, slots, louvres, or micro-perforations with a porosity of 3%-10% of the open surface area (or greater) configured to most effectively reduce or eliminate blower induced and/or broadband noise at the relatively lower speed may be included. With respect to a blower wheel 14 typically operating at a relatively lower speed in the range of 1,000-4,500 RPM, a perforated panel 330, 440A, 440B having holes, slots, louvres, or micro-perforations with a porosity of 3%-10% of the open surface area (or greater) configured to most effectively reduce or eliminate blower induced and/or broadband noise at the relatively higher speed may be included.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A blower assembly comprising:

a housing;

a blower within the housing;

a cut-off within the housing downstream of the blower with respect to direction of airflow generated by the blower; and openings defined by the cut-off, the openings configured to permit airflow generated by the blower to pass through the openings and to a discharge outlet of the blower assembly, the openings further configured to reduce blower frequency tone generated as airflow passes across the cut-off;

wherein the cut-off includes a first chamber having a first upper edge and a second chamber having a second upper edge, the second chamber is smaller than the first chamber and the second upper edge is lower than the first upper edge;

wherein the openings are defined by a perforated panel arranged at each of a first upstream surface of the first chamber, a first downstream surface of the first chamber, a second upstream surface of the second chamber, and a second downstream surface of the second chamber;

wherein the perforated panel includes a first perforated panel extending from the first upstream surface to the first downstream surface of the first chamber;

wherein the perforated panel includes a second perforated panel extending from the second upstream surface to the second downstream surface of the second chamber; and wherein the first perforated panel is arranged in a first cut-out defined by the first chamber, and the second perforated panel is arranged in a second cut-out defined by the second chamber.

2. A blower assembly comprising:

a housing;

a blower within the housing;

a cut-off within the housing downstream of the blower with respect to direction of airflow generated by the blower, the cut-off having an upstream surface facing the blower and a downstream surface opposite to the upstream surface; and openings defined by the cut-off at each one of the upstream surface and the downstream surface, the openings configured to permit airflow generated by the blower to pass through the cut-off to a discharge outlet of the blower assembly, the openings further configured to reduce blower frequency tone generated as airflow passes across and through the cut-off;

wherein the cut-off includes a first chamber having a first upper edge and a second chamber having a second upper edge, the second chamber is smaller than the first chamber and the second upper edge is lower than the first upper edge;

wherein the upstream surface includes a first upstream surface of the first chamber and a second upstream surface of the second chamber;

wherein the downstream surface includes a first downstream surface of the first chamber and a second downstream surface of the second chamber;

wherein the openings are defined by a perforated panel arranged at each of the first upstream surface, the first downstream surface, the second upstream surface, and the second downstream surface;

wherein the perforated panel includes a first perforated panel extending from the first upstream surface to the first downstream surface of the first chamber;

wherein the perforated panel includes a second perforated panel extending from the second upstream surface to the second downstream surface of the second chamber; and wherein the first perforated panel is arranged in a first cut-out defined by the first chamber, and the second perforated panel is arranged in a second cut-out defined by the second chamber.

* * * * *